US005156708A

United States Patent [19]

Mizutani

[11] Patent Number: 5,156,708

[45] Date of Patent: * Oct. 20, 1992

[54] TRANSFER SHEET TO BE USED FOR PRODUCING A DRY TRANSFER MATERIAL

[75] Inventor: Tadashi Mizutani, Nagoya, Japan

[73] Assignee: Brother Kogyo Kabushiki Kaisha, Nagoya, Japan

[ * ] Notice: The portion of the term of this patent subsequent to Oct. 6, 2009 has been disclaimed.

[21] Appl. No.: 782,370

[22] Filed: Oct. 24, 1991

[30] Foreign Application Priority Data

Oct. 25, 1990 [JP] Japan ..... 2-288207

[51] Int. Cl.[5] ..... B44C 1/17

[52] U.S. Cl. ..... 156/234; 428/195; 428/321.5; 428/334; 428/335; 428/336; 428/914

[58] Field of Search ..... 428/321.3, 914, 403, 428/40, 73, 42, 906, 132, 195, 321.5, 334, 335, 336; 156/234

[56] References Cited

FOREIGN PATENT DOCUMENTS

| | | |
|---|---|---|
| 63-128987 | 6/1988 | Japan . |
| 2-74393 | 3/1990 | Japan . |
| 2-81682 | 3/1990 | Japan . |
| 2-81683 | 3/1990 | Japan . |
| 2-81685 | 3/1990 | Japan . |
| 2-81686 | 3/1990 | Japan . |
| 2-81687 | 3/1990 | Japan . |
| 2-209442 | 8/1990 | Japan . |
| 2-218714 | 8/1990 | Japan . |
| 2-288206 | 10/1990 | Japan . |

*Primary Examiner*—B. Hamilton Hess
*Assistant Examiner*—W. Krynski
*Attorney, Agent, or Firm*—Oliff & Berridge

[57] ABSTRACT

A transfer sheet to be used for producing a dry transfer material has microcapsule-encapsulated mold releasing liquid coated on a sheet substrate material, so that the mold releasing liquid is nonfunctional until the microcapsules are ruptured by pressure. The microcapsules containing the mold releasing liquid make an ink layer separate from a transfer sheet more completely and easily upon rupture of the microcapsules, as the ink layer is being deposited on a receiving surface.

30 Claims, 4 Drawing Sheets

Fig.6(A)

| | TIME(hr.) | | |
|---|---|---|---|
| | 0~240(hr.) | 240~480(hr.) | 480~720(hr.) |
| SAMPLE 1 | 0/100 | 0/100 | 0/100 |

Fig.6(B)

| | TIME(hr.) | | |
|---|---|---|---|
| | 0~240(hr.) | 240~480(hr.) | 480~720(hr.) |
| CONVENTIONAL SAMPLE | 0/100 | 45/100 | 68/100 |

TRANSFER SHEET TO BE USED FOR PRODUCING A DRY TRANSFER MATERIAL

BACKGROUND OF THE INVENTION

1. Field of the Invention

This invention relates to a transfer sheet for producing a dry transfer material and, more particularly, relates to a sheet on which a dry transfer image that may be subsequently transferred to a receiving material can be produced.

2. Description of Related Art

Recently, a device for producing dry transfer material which comprises a transfer sheet for dry transfer material and a ribbon cartridge in which an ink ribbon for producing the dry transfer material is stored has been developed and used widely. One such device, Tape Printer "P-touch" manufactured by Brother Industries, Ltd. is well known. A thermal head is installed in the device for producing the dry transfer material. The ink ribbon is brought in contact with a transfer sheet by the thermal head and a number of heating elements, aligned on the thermal head, are caused to generate heat according to electrical signals whereby the ink on the ribbon in contact with the heating elements is heated through a base sheet of the ribbon and fused onto the transfer sheet. Therefore, the dry transfer material, which has the desired ink transfer image such as the character or the figure, can be produced.

And, as shown in FIG. 7, a conventional transfer sheet to be used for producing the dry transfer material comprises a transfer sheet 1 and a surface treating layer 12 provided thereon. Further, as described to Japanese Laid-Open Patent Publication NO.63-128987, Japanese Laid-Open Patent Publication NO.2-74393, Japanese Laid-Open Patent Publication NO.2-81682, Japanese Laid-Open Patent Publication NO.2-81683, Japanese Laid Open Patent Publication NO.2-81685, Japanese Laid-Open Patent Publication NO.2-81686, and Japanese Laid-Open Patent Publication NO.2-81687, the surface treating layer 12 may be composed of one or more kinds of material such as polyethylene, ethylene-vinyl acetate copolymer, ethylene-ethyl acetate copolymer, ethylene-acrylic acid copolymer, ionomer resin, ethylene-methacrylic acid copolymer, silicon and fluorine compounds. Such surface treating layers 12 are provided so that the thermo-sensitive adhesive power between the transfer sheet 1 and the ink transfer image is increased, and the ink transfer image formed on the transfer sheet 1 by the thermo-sensitive ink can be transferred effectively to the receiving material by applying pressure.

The user installs a ribbon cartridge, in which an ink ribbon for producing dry transfer material is stored, in the device for producing the dry transfer material. The user then inputs the characters or figures, by means of a key board or other external data source, the user wants recorded on the dry transfer material. Following the data input, the heat-generating elements of the device corresponding to characters or figures to be recorded are heated according to the input character and figure data. The ink from the ink ribbon for producing the dry transfer material is transferred to a surface treating layer 12 on a transfer sheet 1, whereby the dry transfer material, that is the transferred image consisting of characters and figures formed on the transfer sheet 1, is produced. To use the dry transfer material, the user presses the dry transfer material against a desired surface and transfers the ink image to the surface with the application of pressure to a side opposite the ink image.

However, with current transfer materials, there is a problem that the quality of the transferred image is not good after being transferred from the dry transfer material to the receiving surface.

To transfer the known dry transfer material, the user must place the side of the transfer sheet 1 having the ink transfer image in contact with the surface of the receiving material, such as paper, plastic, metal, or wood, and then the user must rub, for a long period of time, the back side of the transfer sheet 1.

However, it was difficult to obtain a high quality transferred image because collapse and spreading of the ink transferred image results if the transfer sheet 1 is insufficiently fixed with respect to the receiving material surface and the transfer sheet 1 shifts position during the rubbing and transfer.

SUMMARY OF THE INVENTION

It is an object of the present invention to overcome the above described drawbacks and disadvantages of known dry transfer materials and to provide a transfer sheet for producing a dry transfer material capable of easily transferring an ink transfer image adhered on the transfer sheet to the surface of a receiving material so that the transferred image has a perfect shape without collapse.

Another object of the present invention is to provide a transfer sheet for producing dry transfer material capable of completing the transfer in a very short time by application of little pressure to the reverse side of the transfer sheet.

To attain these and other objects, according to the invention, there is provided a transfer sheet to be used for producing a dry type image-transfer material, the transfer sheet comprising: a sheet substrate material and a layer formed on the sheet substrate material, the layer including a microcapsule encapsulated mold releasing agent which can be ruptured by an external pressure.

As mentioned above, according to the invention thus structured, the mold releasing layer, which includes microcapsules containing a mold releasing agent therein which are ruptured by an external pressure, is placed on the side of the transfer sheet on which the ink transfer image is transferred. When a moderate pressure is applied from the reverse side of the transfer sheet, the microcapsules are ruptured and the mold releasing agent contained therein flows out. As a result, the ink transfer image is released from the transfer sheet in a very short time and is transferred to the desired receiving material, such as paper, plastic, metal, or wood. In the present invention, the mold releasing liquid easily infiltrates between the ink transfer image and the transfer sheet because a liquid type mold releasing agent is used and the mold releasing liquid which has a strong releasing property can be used, so that the ink transfer image can be released from the transfer sheet in a short time compared with conventional methods.

When such a transfer sheet is used to produce a dry transfer material, there is no residual ink left on the transfer sheet when the ink transfer image, printed using the thermo-sensitive transfer method on the transfer sheet, is pressure transferred onto the desired receiving material by the momentary application of pressure from the reverse side of the transfer sheet. Further, there is no collapse, spreading, and brittleness in the ink image which is pressure transferred. Therefore, an excellent image which is strongly adhered to the receiving material is obtained.

BRIEF DESCRIPTION OF THE DRAWINGS

A preferred embodiment of the present invention will be described in detail with reference to the following figures wherein:

FIGS. 6(A) and 6(B) are tables of shelf life data of the pressure-sensitive transferred image formed on a receiving material by the dry transfer material produced from the first embodiment and that of the related art.

DETAILED DESCRIPTION OF THE PREFERRED EMBODIMENTS

Figure 1:
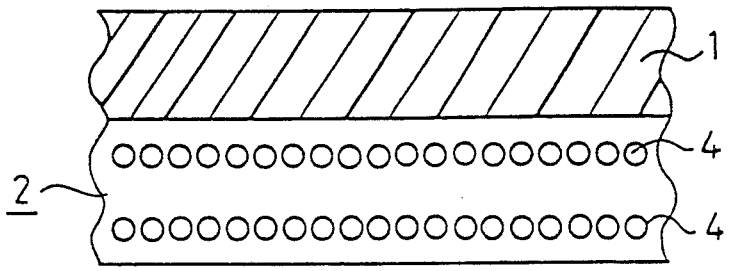
FIG. 1 is an expanded sectional view of a first embodiment of a sheet of a dry transfer material.
Figure 2:
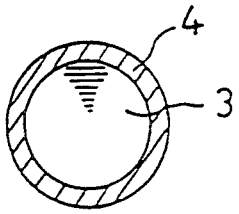
FIG. 2 is an expanded sectional view of a microcapsule containing a mold releasing agent.

FIG. 1 is an expanded sectional view showing a first embodiment of a sheet of a dry transfer material.

As shown in FIG. 1, the sheet of the dry transfer material is composed of a transfer sheet 1 and a mold releasing layer 2 which is provided thereon. The mold releasing layer 2 includes microcapsules 4 which contain a mold releasing agent 3 for releasing an ink transfer image, and which are ruptured by an external pressure.

Many types of mold releasing agents 3 can be used in the present invention. Preferred mold releasing agents may be silicon oils, fluorine resins, olefin resins, paraffin waxes or other waxes having comparable properties.

As the wall material of the microcapsules 4, that is ruptured by an external pressure, materials such as melamine-formaldehyde resin, urea-formaldehyde resin, gelatin, gum arabic, polyvinyl alcohol, albumen, alginic acid salt, zein, casein, methylcellulose, carboxymethylcellulose, collagen, ethylene-maleic anhydride copolymers, vinyl methyl ether-maleic anhydride copolymers, urea-formalin resin, melamine-formalin resin, poly-urethane resin, and polyurea can be used.

It is desirable that the diameter of each microcapsule 4 be in the range of 0.1 to 20 μm (microns) and, preferably, is in the range of 0.5 to 10 μm, in order to obtain an excellent transferred image on a receiving material using a pressure equivalent to a stamp pressure in the range of 10 g/cm$^2$–2000 g/cm$^2$. If the capsule diameter of the microcapsules 4 is less than 0.1 μm, the microcapsules 4 do not rupture easily and the lowest pressure necessary to rupture the microcapsule is increased greatly. On the other hand, if the diameter of the microcapsules 4 is more than 20 μm, the crisp transfer of small characters or figures, for example, is not obtained. Therefore, the above-mentioned size range is preferred.

The desirable coating thickness of the layer 2, containing the microcapsules 4, is in the range of 1 to 20 μm, preferably is in the range of 1 to 10 μm. If the coating thickness of the layer 2 is less than 1 μm, the releasability necessary to obtain an excellent pressure-sensitive transfer is not obtained. On the other hand, if the coating thickness of the layer 2 is more than 20 μm, the transferred image may bleed because of an excess of mold releasing agent and a sharp or crisp transferred image may not be obtained.

As the transfer sheet 1 of the dry transfer material 5 of the present invention, various materials may be used. The transfer sheet 1 is generally provided to be confronting with a thermal head through an ink ribbon for thermal transfer printing, and the heat of the thermal head may be conducted to the transfer sheet 1. Therefore, the transfer sheet 1 preferably has a heat resistance of 150 degrees C. or higher. Thus, polyester films, such as polyethylene terephthalate (PET) and polybutylene terephthalate; polyimide films; polycarbonate films; polysulfone films; polyethersulfone films; polyphenylene sulfide films; or papers, such as condenser paper and glassine paper, may be used.

A desirable thickness of the transfer sheet 1 is in the range of 10–250 μm. In particular, the optimum thickness is in the range of 20 to 100 μm, in order to obtain an excellent transferred image by a pressure equivalent to a stamp pressure in the range of 10 g/cm$^2$–2000 g/cm$^2$. If the thickness of the transfer sheet 1 is less than 10 μm, the transfer sheet 1 is not smoothly transported in the printing device. On the other hand, if the thickness of the transfer sheet 1 is more than 250 μm, the microcapsules 4 are not ruptured easily because a higher pressure must be applied from the reverse side of the transfer sheet 1 to rupture the microcapsules 4.

Further, as a dispersant or an emulsifier which are primarily used when the microcapsules 4 containing the mold releasing agent 3 are formed or when the microcapsule solution is dispersed or emulsified, the following well known dispersants and emulsifiers may be used. As the dispersant, ionic surfactants, such as sodium hexametaphosphate and condensed sodium naphthalenesulfonate may be used. As the emulsifier, nonionic surfactants such as glycerine fatty acid ester, sucrose fatty acid ester, sorbitan fatty acid ester and propylene glycol fatty acid ester, may be used.

In addition, a binder agent, a tackifier and a surface modifier may also be contained in the mold releasing layer 2.

The primary binder agent may be a resin binder. The resin binder may be composed of one or more kinds of materials selected from: lipophilic binders such as proteinic binders including casein and zein, and cellulosic binders, including nitrocellulose and acetylcellulose; water-soluble binders, such as polyvinyl alcohol, sodium polyacrylate, polyethylene oxide, carboxymethylcellulose, polyvinyl pyrrolidone and hydroxypropylcellulose; thermoplastic binders, such as polyester resin including polyamide resin and polybutylene terephthalate, polyether resin including polycarbonate resin and polyphenylene oxide, polyethylene resin, polypropylene resin, polystyrene resin, polyvinyl chloride resin, ethylene-vinyl acetate copolymer, polymethyl (methyl methacrylate), ionomer resin and fluorine resin; thermosetting binders, such as phenol resin, urea resin, melamine resin, epoxy resin, silicone resin, polyimide resin and polyurethane resin.

Also, the primary binder agent may be a wax. The wax may be composed of one or more kinds of material selected from: plant waxes, such as candelilla wax, carnauba wax, rice wax, and Japan wax; animal waxes such as bees waxes, lanolin, and whale waxes; mineral waxes such as montan waxes and ceresin; petroleum waxes such as paraffin wax, and microcrystalline wax.

Further a binder agent composed of resin binders and waxes may be used.

The tackifier acts to improve the adhesion and hardness of an ink, to give cohesion and tacking strength to the ink, and to give tackiness to the thermo-sensitive adhesive and the pressure-sensitive adhesive components. The tackifier may be composed of a mixture of one or more kinds of resin such as petroleum resin, rosin resin, ketone resin, polyamide resin, and phenolic resin.

The surface modifier enables the ink ribbon to have an excellent shelf life, without one layer of ribbon sticking to another (blocking), and to have an excellent running property, without the meander and slipping caused by losing the tackiness on a surface of the ink ribbon thereby reducing the frictional resistance. As the surface modifier, well-known materials such as fluorine-containing polymers and silicone polymers may be used.

EXAMPLE 1

As shown in FIG. 1, a transfer sheet of a dry transfer material comprises a transfer sheet 1 and the mold releasing layer 2, which includes microcapsules 4 containing a mold releasing agent 3, provided thereon.

A manufacturing process for the sheet of the dry transfer material 5 will be explained.

First, a fine dispersing and fine emulsifying process of the mold releasing agent is performed. In this process, a silicon oil mold releasing agent, melamine and formaldehyde dissolved in an oil solution are added, with stirring, to an aqueous solvent. A nonionic surfactant is added to the resultant solution to create a stable, fine emulsion. The resulting fine emulsion contains the silicon oil mold releasing agent.

Then a microcapsule making process is continuously performed. In this process, melamine-formaldehyde resin, which forms the wall material of the microcapsules, is added, with stirring, to the finely dispersed solution or emulsion while heat is applied. As a result, a melamine-formaldehyde resin is formed which forms the microcapsules containing the silicon oil mold releasing agent.

Next, the microcapsules are subjected to a fine dispersing and fine emulsifying process. In this process, the microcapsules 4 produced above are dispersed or emulsified by stirring in an aqueous solution and a resin binder, such as polyvinyl pyrrolidone is added.

The microcapsule solution is then coated on a polyethylene terephthalate (PET) transfer sheet 1 using a well-known coating method, such as the bar coating method, the blade coating method, the air-knife coating method, the gravure coating method, the roll coating method, the spray coating method or the dip coating method.

The transfer sheet 1 on which the microcapsule solution has been coated is heated and dried under atmospheric conditions at a temperature of 110° C. As a result, the mold releasing layer 2 is formed on the transfer sheet 1. Thus, the sheet of the dry transfer material is obtained by this drying process of the microcapsule coated layer.

Figure 3:
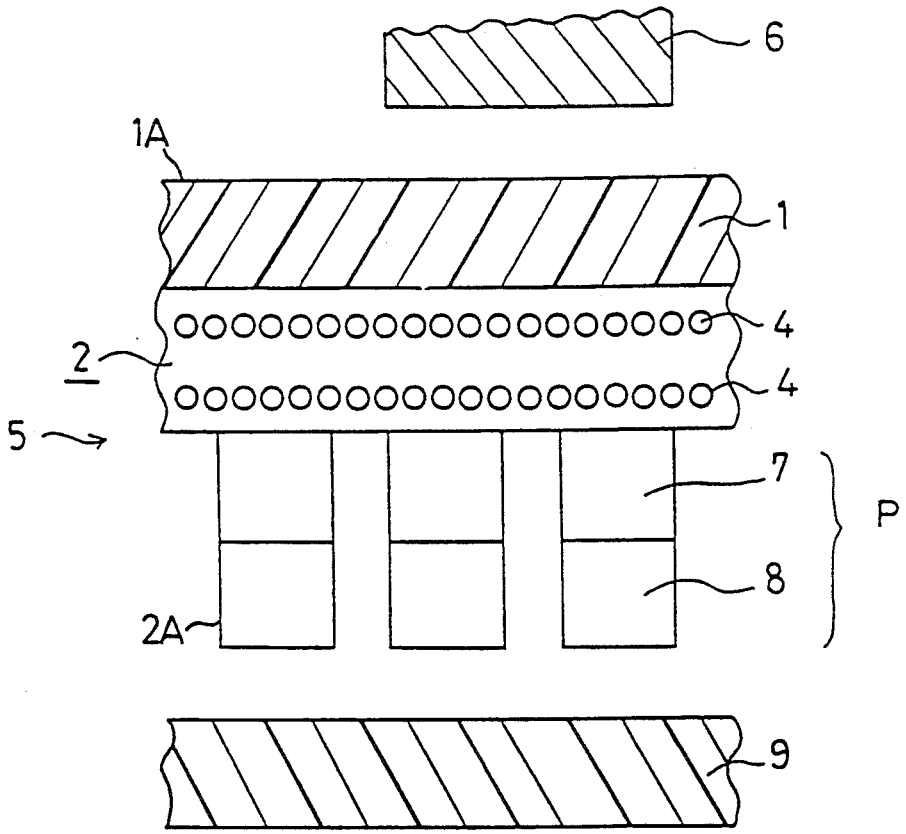
FIG. 3 is an expanded sectional view of a dry transfer sheet of the first embodiment.

FIG. 3 is an expanded sectional view of a dry transfer material 5. The dry transfer material 5 is made by placing an ink transfer image P and the mold releasing layer 2, including the microcapsules 4 containing the mold releasing agent 3, on the transfer sheet 1. The ink transfer image P thermally transferred to the transfer sheet from an ink ribbon (not shown) is retransferred to a receiving material 9.

Next, the method for manufacturing the dry transfer material 5 is briefly explained.

First, a ribbon cartridge is assembled containing the ink ribbon which comprises a pressure-sensitive adhesive ink layer 8 and a thermo-sensitive adhesive layer 7 on a film-like ribbon substrate (not shown). The ribbon cartridge is installed in a device for producing the dry transfer material (for example, Tape Printer "P-touch" manufactured by Brother industries, Ltd.) having a built-in thermal head. The transfer sheet 1 is positioned with the mold releasing layer 2 facing the side of the ink ribbon opposite to the side which the thermal head contacts.

Data to be recorded on the mold releasing layer 2 on the transfer sheet 1 is input and the heat-generating elements of the thermal head, corresponding to characters or figures to be recorded, are heated to a temperature greater than the melting temperature of the thermo-sensitive adhesive layer 7 and the pressure-sensitive adhesive ink layer 8. Therefore, the transfer image is thermo-sensitively transferred from the ink ribbon onto the mold releasing layer 2 on the transfer sheet 1 to produce the dry transfer material 5 having the desired ink transfer images P thereon.

The thermo-sensitive adhesive layer 7 contains a thermo-sensitive adhesive component. The thermo-sensitive adhesive component may be composed of one or more kinds of resin having high thermo-sensitive adhesiveness such as ethylene-vinyl acetate copolymer, polyvinyl acetate, ionomer resin, acrylic polymer, ethylene-ethyl acetate copolymer, ethylene-acrylic acid copolymer, vinyl chloride-vinyl acetate copolymer, polyvinyl butyryl, polyvinyl pyrrolidone, polyvinyl alcohol, polyamide, and ethyl cellulose.

The pressure-sensitive adhesive ink layer 8 contains a pressure-sensitive adhesive component and a coloring agent. The pressure-sensitive adhesive component may be composed of one or more kinds of material in combination selected from a group consisting of: vinyl polymers such as polyvinyl chloride, polyacrylic ether, ethylene-vinyl acetate copolymer, ethylene-ethyl acetate copolymer, polyvinyl acetate, polyvinyl ether, polyvinyl acetal, and polyiso-butylene; fibrous polymers such as ethyl cellulose, nitrocellulose, and cellulose acetate; and rubber(-like) polymers such as rubber chloride and natural rubber.

As the coloring agent, pigments such as carbon black are generally used. However, if desired, dyes such as a leuco dye, to be colored by an acid, and a diazo dye, to be colored by a base, may be added to adjust the color tone of the ink, although the invention is not limited to the identified coloring agents.

As a coloring element of the leuco dye, to be colored by an acid, well-known materials such as phthalide compounds, fluoran compounds, lactone compounds, triphenylmethane compounds, rhodamine lactam compounds, and quinone compounds can be used. As a developer for making the leuco dye colored, phenol materials or acid materials are mainly used. The color reaction progresses based on the coloring element and the coloring temperature.

The diazo dye to be colored, by a base, is constructed by combining a diazo compound, which is an acidic material, and a coupling compound which is basic dye-precursor. It is colored based on the contact of the materials while being heated.

In addition, a tackifier, a binder agent and a surface modifier may also be contained in the thermo-sensitive adhesive and the pressure-sensitive adhesive components.

When a side 2A of the dry transfer material 5 on which the ink transfer image P is formed, is placed on the surface of the receiving material 9, and a pressure equivalent to the stamp pressure is applied to a side 1A of the dry transfer material 5 from a pressing element 6, the microcapsules 4 are ruptured, and the silicon oil mold releasing agent contained therein flows out to substantially reduce the adhesion between the mold releasing layer 2 and the ink transfer image P. The result is a desirable transferred ink image that is pressure-sensitively transferred onto the receiving material 9, such as paper, plastic, metal, and wood. The transferred image has an excellent image quality without collapse, spreading, or brittleness.

The stamp pressure from the pressing element 6 necessary for pressure-sensitive transfer is set primarily according to the pressure which is necessary to rupture the microcapsules 4. The desirable stamp pressure, as previously noted, is in the range of 10 g/cm$^2$ to 2000 g/cm$^2$. In particular, the optimum stamp pressure is in the range of 70 g/cm$^2$ to 1000 g/cm$^2$ in order to obtain an excellent transferred image without excessive effort. If the dry transfer material 5 is such that the microcapsules 4 included therein may be ruptured with a stamp pressure of less than 10 g/cm$^2$, the microcapsules 4 are too easily ruptured and the pressure-sensitive transfer is too easily performed. Therefore, the shelf life of the dry transfer material 5 decreases as it is easily damaged. On the other hand, if the dry transfer material 5 is such that the microcapsules 4 included therein are ruptured by a stamp pressure of more than 2000 g/cm$^2$, the microcapsules 4 are not easily ruptured and an excellent pressure-sensitive transferred image is not obtained.

Moreover, because the silicon oil mold releasing agent flows rapidly on rupture of the microcapsules 4, the adhesion between the mold releasing layer 2 and the thermo-sensitive adhesive layer 7 decreases rapidly and the pressure-sensitive transferred image can be transferred completely in a short time.

The results obtained by observing and comparing the shelf life of the transferred image made from the dry transfer material produced using the ink ribbon of the invention and that of a conventional transferred image are shown in FIGS. 6(A) and (B).

In this test, the dry transfer material and the transferred image produced therefrom were visually observed after being left continuously under controlled atmospheric conditions at a temperature of 60 degrees C. and 80% relative humidity. The number of samples, in one hundred examination samples, in which bleedings, cracks and changes of hue were confirmed provided the measured result.

The conventional pressure-sensitive transfer image was obtained using a dry transfer material made from a conventional transfer sheet for producing dry transfer material which does not include the microcapsules containing the mold releasing agent therein.

In the invention, the mold releasing layer containing the silicon oil mold releasing agent has excellent heat-proof and water repellent characteristics. Therefore, in the image obtained from the dry transfer material made in accordance with the invention, no cracks, bleedings and changes of hue were observed, even after 480 to 720 hours had passed. However, with the images transferred from the conventional dry transfer material, bleedings, cracks and/or changes of hue result before 240 hours have passed and their numbers increased with the passage of time. Therefore, it was found that the shelf life of dry transfer materials made in accordance with the invention is substantially improved over the conventional dry transfer material.

EXAMPLE 2

Figure 4:
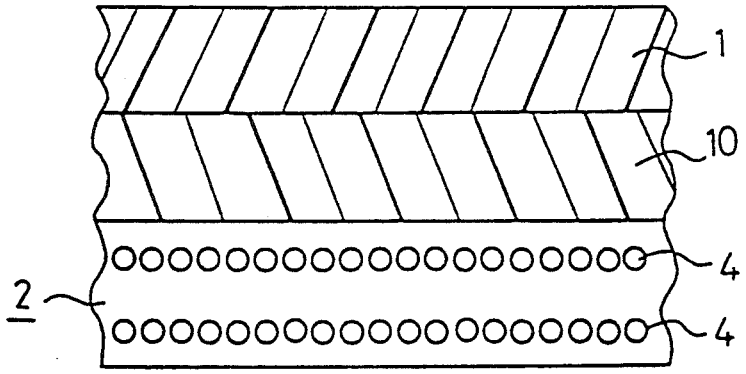
FIG. 4 is an expanded sectional view of a second embodiment of a sheet of a dry transfer material.

A second embodiment of a sheet of the dry transfer material in accordance with the invention is shown in FIG. 4. A interfacial modifying layer 10 is placed on the transfer sheet 1, and the mold releasing layer 2 including microcapsules 4 encapsulating the mold releasing agent is placed thereon.

The interfacial modifying layer 10 includes, as a principal component, a material that improves the adhesion between the transfer sheet 1 and the mold releasing layer 2. Preferably the material is relatively hard and exhibits only low expansion under heat and/or pressure. The interfacial modifying layer material can be composed of one or more types of resin having high thermo-sensitive adhesiveness, such as polyvinyl butyryl and ethyl cellulose, and a tackifier composed of one or more types of resin, such as rosin and phenolic resin.

As was the case in EXAMPLE 1, a dry transfer material was made by using the sheet of the dry transfer material of the second embodiment and its pressure-sensitive transferability was examined. It was found that a transferred image having an excellent quality without collapse, spreading, and brittleness was obtained because the silicon oil mold releasing agent flowed quickly causing the adhesion between the mold releasing layer 2 and the ink transfer image P to decrease quickly.

Moreover, because the interfacial modifying layer 10 is placed between the transfer sheet 1 and the mold releasing layer 2 including microcapsules 4 encapsulating the mold releasing agent 3, the adhesion between the transfer sheet 1 and the mold releasing layer 2 is improved. When the pressure is applied to the reverse side of the transfer sheet 1 and the pressure-sensitive transfer is performed, the mold releasing layer 2 does not slide off the transfer sheet 1, so that the microcapsules 4 are ruptured and the silicon oil mold releasing agent contained therein flows out effectively. And also it is found that the shelf life of the sheet of the dry transfer material is improved.

Further, the shelf life of the transferred image produced from the dry transfer material of the second embodiment and that of a conventional dry transfer material are observed and compared as was done with EXAMPLE 1. It was found from the result that the shelf life of the transferred image obtained from using the sheet of the dry transfer material of the EXAMPLE 2 was as good as that of the EXAMPLE 1 material.

EXAMPLE 3

Figure 5:
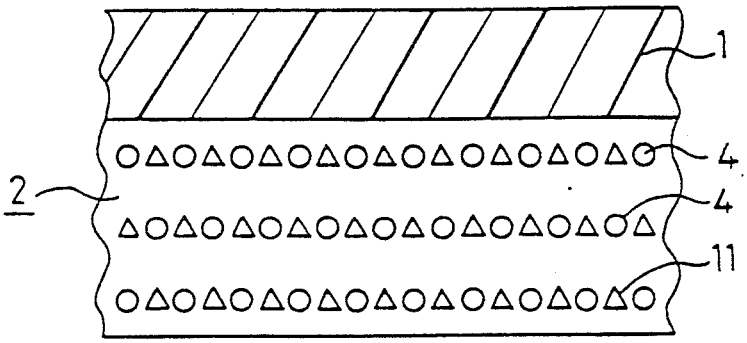
FIG. 5 is an expanded sectional view of a third embodiment of a sheet of a dry transfer material.
Figure 7:
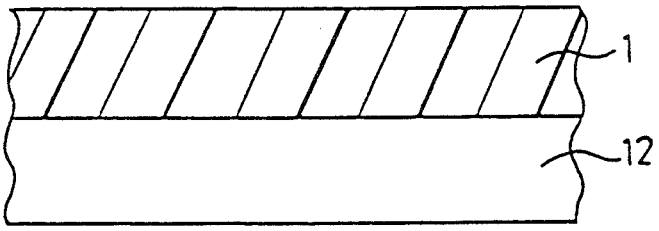
Fig.7 RELATED ART
FIG. 7 is an expanded sectional view of a conventional sheet of a dry transfer material.

A third embodiment of a sheet of the dry transfer material in accordance with the invention is shown in FIG. 5. In this embodiment, a principal component of a surface treating agent 11 is added in the mold releasing layer 2, which includes microcapsules 4 encapsulating the mold releasing agent. The principal components of surface treating agent 11 may be, for example, one or more materials, such as polyethylene, ethylene-vinyl acetate copolymer, ethylene-ethyl acetate copolymer, ethylene-acrylic acid copolymer, ionomer resin, ethylene-methacrylic acid copolymer, combined with at least one of silicone compounds or fluorine compounds.

As was the case in EXAMPLE 1, a dry transfer material was made by using the sheet of the dry transfer material of the third embodiment and its pressure-sensitive transferability was examined. It was found that a transferred image having an excellent quality without collapse, spreading, and brittleness was obtained because the silicon oil mold releasing agent flowed quickly causing the adhesion between the mold releasing layer 2 and the ink transfer image P to decrease commencing immediately.

Moreover, because the mold releasing layer 2 including the principal component of surface treating agent 11 and the microcapsules 4 encapsulating the mold releasing agent 3 is provided on the transfer sheet 1 in the EXAMPLE 3, the adhesion between the transfer sheet 1 and the mold releasing layer 2 is improved. When pressure is applied to the reverse side of the transfer sheet 1 and the pressure-sensitive transfer is performed, the mold releasing layer 2 does not slide off the transfer sheet 1, so that the microcapsules 4 are ruptured and the silicon oil mold releasing agent contained therein flows out effectively. And also it was found that the shelf life of the sheet of the dry transfer material is improved.

An important aspect of the surface treating agent 11 is that it brings about an increase in the rate of expansion of the mold releasing layer 2 when pressure is applied to the backside of the transfer sheet 1, without changing the rate of expansion of the ink transfer image P. The pressure transfer is improved by having a differential between the expansion rate of mold releasing layer 2 and ink transfer images P. Also, it is desirable to have the expansion of mold releasing layer 2 be as uniform as possible. In addition, the surface treating agent 11 controls the amount of adhesive force between the mold releasing layer 2 and the transfer sheet 1 so that there is a balance between adhesion and release properties.

Further, the shelf life of the transferred image produced from the dry transfer material of the third embodiment and that of a conventional dry transfer material are observed and compared as was done with EXAMPLE 1 and EXAMPLE 2 materials. It was found from the result that the shelf life of the transferred image obtained from using the sheet of the dry transfer material of the EXAMPLE 3 was much superior to that of the conventional dry transfer material.

While this invention has been described in connection with specific embodiments thereof, many alternatives, modifications and variations will be apparent to those skilled in the art.

Accordingly, the preferred embodiments of the invention as set forth herein are intended to be illustrative, not limiting. Various changes may be made without departing from the spirit and scope of the invention as defined in the following claims.

What is claimed is:

1. A transfer sheet to be used for dry image-transfer comprising:

a sheet substrate material; and a mold releasing layer formed on said sheet substrate, material, said layer including a microcapsule encased mold releasing agent.

2. The transfer sheet as in claim 1, wherein the material forming said sheet substrate material has a heat resistance of 150 degrees C. or higher.

3. The transfer sheet as defined in claim 2, wherein said sheet substrate material is about 10 to about 250 microns thick.

4. The transfer sheet as in claim 1, wherein the diameter of said microcapsules is about 0.1 to about 20 microns.

5. The transfer sheet as in claim 1, wherein the walls of said microcapsules are formed to be ruptured by a force between about 10 g/cm$^2$ to about 2000 g/cm$^2$.

6. The transfer sheet as in claim 5, wherein the material forming an outside wall of said microcapsules is selected from the group consisting of melamine-formaldehyde resin, urea-formaldehyde resin, gelatin, gum arabic, polyvinyl alcohol, albumen, alginic acid salt, zein, casein, methylcellulose, carboxymethylcellulose, collagen, ethylene-maleic anhydride copolymers, vinyl methyl ether-maleic anhydride copolymers, urea-formalin resin, melamine-formalin resin, polyurethane resin, and polyuria.

7. The transfer sheet as in claim 1, wherein said mold releasing layer containing said microcapsule encased releasing agent is about 1 to about 20 microns thick.

8. The transfer sheet as in claim 1, further comprising a layer of dry ink disposed on said microcapsule layer.

9. The transfer sheet as in claim 8, wherein the layer of dry ink is in the form of an image to be transferred from the transfer sheet.

10. The transfer sheet as in claim 1, further comprising an interfacial modifying layer disposed between the sheet substrate material and the mold releasing layer for adhering the ttansfer sheet to the mold releasing layer.

11. The transfer sheet as in claim 10, wherein the interfacial modifying is a material selected from the group consisting of polyvinyl butyrl and ethyl cellulose and a material selected from the group consisting of rosin and phenolic resin.

12. The transfer sheet as in claim 1, further comprising a surface treating agent for influencing the adhesion between the substrate material and the mold releasing layer.

13. The transfer sheet as in claim 12, wherein the surface treating agent is a material selected from the group consisting of polyethylene, ethylene-vinyl acetate copolymer, ethylene-ethyl acetate copolymer, ethyleneacrylic acid copolymer, ionomer resin, ethylene-methacrylic acid copolymer and a material selected from the group consisting of silicone and fluorine compounds.

14. A dry transfer sheet, comprising:

a substrate; and a release layer containing a microcapsule encased mold releasing agent.

15. The sheet as in claim 14, wherein said substrate is about 10 to about 250 microns thick.

16. The sheet as claimed in claim 15, wherein said substrate is about 20 to about 100 microns thick.

17. The sheet as claimed in claim 14, wherein the diameter of said microcapsules is in a range of about 0.1 to about 20 microns.

18. The sheet as in claim 17, wherein the range of said diameter is about 0.5 to about 10 microns.

19. The sheet as in claim 14, wherein said release layer is about 1 to about 20 microns thick.

20. The sheet as in claim 19, wherein said release layer is about 1 to about 10 microns thick.

21. The sheet as in claim 14, wherein said microcapsules rupture under a pressure in the range of about 10 g/cm$^2$ to about 2000 g/cm$^2$.

22. The sheet as claimed in claim 21, wherein said range in which said microcapsules rupture is about 70 $g/cm^2$ to about 1000 $g/cm^2$.

23. The transfer sheet as in claim 14, further comprising an interfacial modifying layer disposed between the sheet substrate material and the mold releasing layer for adhering the transfer sheet to the mold releasing layer.

24. The transfer sheet as in claim 23, wherein the interfacial modifying is a material selected from the group consisting of polyvinyl butyrl and ethyl cellulose and a material selected from the group consisting of rosin and phenolic resin.

25. The transfer sheet as in claim 14, further comprising a surface treating agent for influencing the adhesion between the substrate material and the mold releasing layer.

26. The transfer sheet as in claim 25, wherein the surface treating agent is a material selected from the group consisting of polyethylene, ethylene-vinyl acetate copolymer, ethylene-ethyl acetate copolymer, ethylene-acrylic acid copolymer, ionomer resin, ethylene-methacrylic acid copolymer and a material selected from the group consisting of silicone and fluorine compounds.

27. The transfer sheet as in claim 11, further comprising a layer of dry ink disposed on said microcapsule layer.

28. The transfer sheet as in claim 20, wherein the layer of dry ink is in the form of an image to be transferred from the transfer sheet.

29. A method of dry transferring an image comprising the steps of:

forming a dry ink image on a surface of a transfer sheet having a microcapsule encased release agent disposed thereon;

positioning the transfer sheet on an image-receiving medium to receive the dry ink image; and rupturing the microcapsules as the dry ink image is transferred to the image-receiving medium.

30. The method as in claim 27, wherein the step of rupturing the microcapsules comprises applying pressure to a surface of the transfer sheet opposite to the surface on which the microcapsules are disposed when the dry ink image is transferred to the image-receiving medium.

* * * * *